United States Patent [19]

Dickson et al.

[11] Patent Number: 4,880,284

[45] Date of Patent: Nov. 14, 1989

[54] CHEST OF DRAWERS AND METHOD OF ASSEMBLY

[75] Inventors: James E. Dickson; Dario Vasquez, Jr., both of Pearland, Tex.

[73] Assignee: Wholesale Furniture Distributors, Inc., Houston, Tex.

[21] Appl. No.: 294,354

[22] Filed: Jan. 9, 1989

[51] Int. Cl.[4] ..... A47B 43/00

[52] U.S. Cl. ..... 312/263; 312/257.1; 312/330.1

[58] Field of Search ..... 312/330 R, 263, 264, 312/257 R, 350

[56] References Cited

U.S. PATENT DOCUMENTS

| | | | |
|---|---|---|---|
| 298,821 | 5/1884 | Brolaski | 312/264 |
| 3,069,216 | 12/1962 | Vaeth | 312/257 R X |
| 3,285,684 | 11/1966 | Duncan | 312/257 R |
| 3,379,483 | 4/1968 | Oldford | 312/263 |
| 3,784,273 | 1/1974 | Nikolai | 312/257 R X |
| 4,466,675 | 8/1984 | Ferdinand et al. | 312/330 R X |
| 4,489,994 | 12/1984 | Williams | 312/350 |

*Primary Examiner*—Joseph Falk

*Attorney, Agent, or Firm*—Dodge, Bush & Moseley

[57] ABSTRACT

A knock down chest of drawers (10) assembled from a plurality of prepackaged flat panels without any separate fasteners includes a detachable frome (12) having a pair of said panels (16, 18) with a plurality of horizontal grooves (32) therein. Detachable drawers (14) are formed of a bottom panel (56) having side panels (62) supported thereon. The bottom panel (56) has side supporting flanges (74) which extend outwardly beyond the side panels (62) and fit within a pair of opposed grooves (32) in the side panels (16, 18) of the frame (12) to mount the drawers (14) for sliding movement between open and closed positions.

10 Claims, 2 Drawing Sheets

FIG. 1
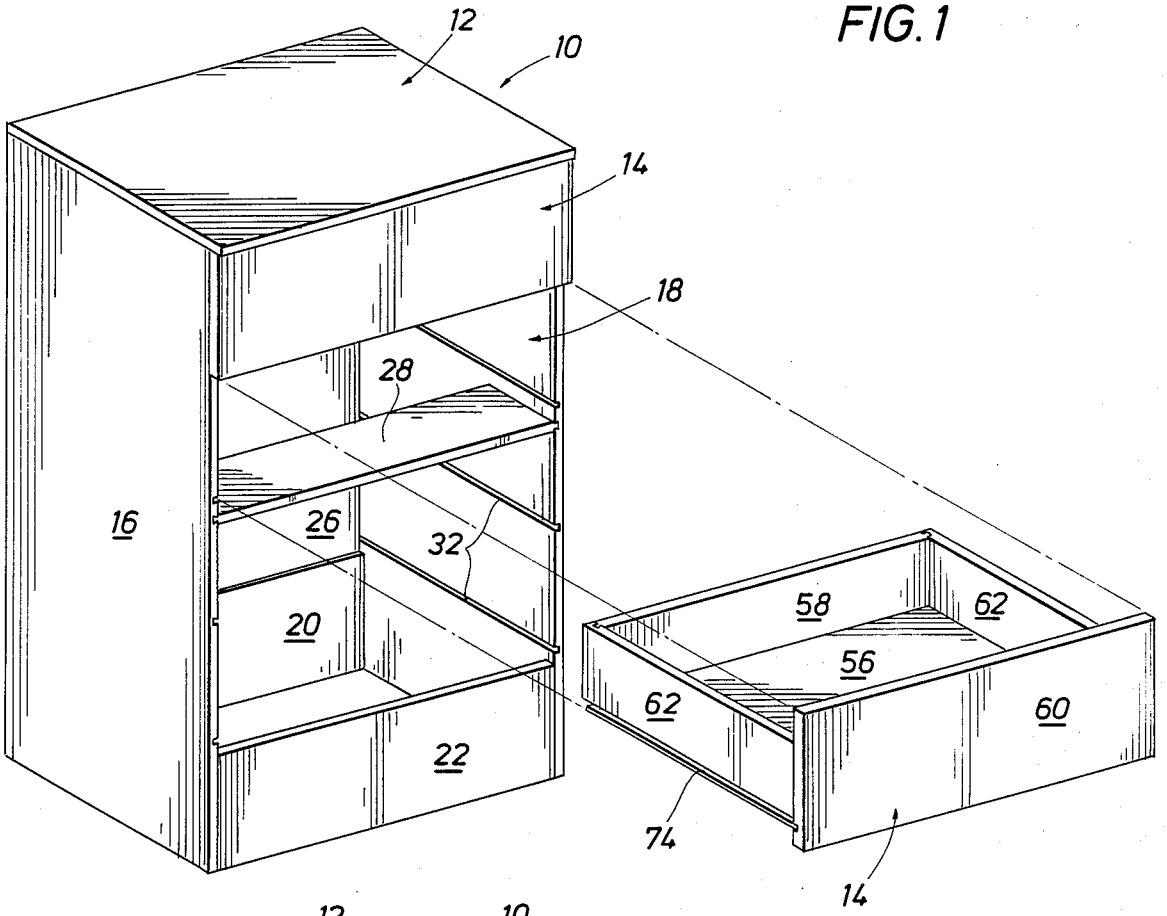
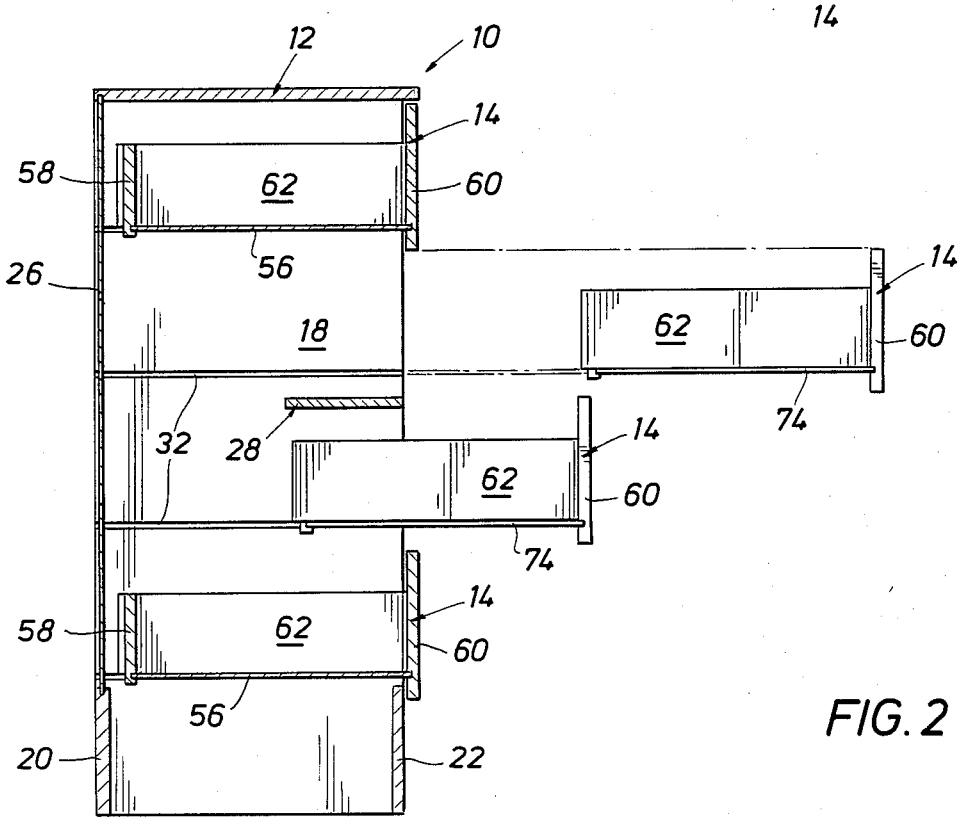
FIG. 2

CHEST OF DRAWERS AND METHOD OF ASSEMBLY

BACKGROUND OF THE INVENTION

This invention relates to a chest of drawers and method of assembly, and particularly to a so-called "knock down" chest of drawers which may be assembled manually from a plurality of prepackaged flat panels Heretofore, particularly with the mass merchandising of furniture, it has been common to prepackage various types of furniture in disassembled relation with the purchaser assembling the furniture for use after purchased. It is, of course, highly desirable that a minimum number of pieces or parts be provided for assembly, and that the pieces be assembled simply with minimal skill being required.

It has also been common heretofore to provide separate fasteners, such as metal screws or nut and bolt combinations, for securing the various parts together. Such separate fasteners must be properly matched for the associated part, and if misplaced prevent the assembly of the furniture. Additionally, metal fasteners, particularly for wood or other soft materials, may be loosened after use from wear of the soft material resulting from frictional contact with the metal fasteners.

In the construction of a chest of drawer consisting of a frame or case and a plurality of drawers supported by the frame in sliding supporting relation, it has been common to provide separate runners or supports on the sides of the frame to support the drawers for sliding movement.

SUMMARY OF THE INVENTION

The present invention is directed to a chest of drawers and method of assembly, and particularly to a knock down chest of drawers assembled manually from a plurality of flat panels. A chest of drawers consists of a frame or case and a plurality of separate drawers which are supported by the frame for sliding back and forth movement for opening and closing. Any desired number of drawers may be provided, such as three, four, or five drawers, for example.

The frame and drawers of the present invention are formed of a minimal number of parts and are assembled without the use of any separate fasteners. Each drawers is formed from five flat panels which are easily interfitted to provide the completed drawers, and the frame is formed of only seven flat panels which are easily interfitted to provide the completed frame for receiving the drawers in a sliding supporting supporting relation.

All of the panels for the drawer, except the bottom panel, and all of the panels for the frame, except the back panel, are connected to each other at interfitting dovetail joints without the use or necessity of any separate connectors or fasteners. Each dovetail joint includes a male dovetail tongue and an interfitting female dovetail groove. The tongues are provided along the end edges of the panels while the grooves are provided along the inner sides of the interfitting coacting panels.

Another feature of the invention is the assembly of the drawers so that the bottom panel of each drawer has opposed side flanges which extend laterally outwardly from the superajacent sides of the drawer and fit within opposed inner horizontal grooves of the sides of the frame for supporting the drawer within the grooves for sliding movement.

It is an object of this invention to provide a knock down chest of drawers which may be manually assembled from a plurality of prepackaged flat panels in a minimum of time without the use of any separate fasteners or connectors.

It is a further object of this invention to provide such a chest of drawers from a minimal number of parts or pieces with the parts being connected to each other at interfitting dovetail joints.

An additional object of the invention is to provide a drawer for a chest of drawer which is formed solely from five parts and is supported in sliding relation within the frame of the chest of drawer by opposed side marginal portions of a bottom panels forming flanges fitting within grooves in the inner sides of the frame.

Other objects, features and advantages of this invention will become more apparent after referring to the following specification and drawings.

BRIEF DESCRIPTION OF THE DRAWINGS

FIG. 1 is a perspective of an assembled chest of drawers comprising the present invention and showing one drawer removed from the chest of drawers;

FIG. 2 is a longitudinal sectional view of FIG. 1 showing four drawers with one drawer being removed from the frame and one drawer being partially opened;

DESCRIPTION OF THE INVENTION

Figure 3:
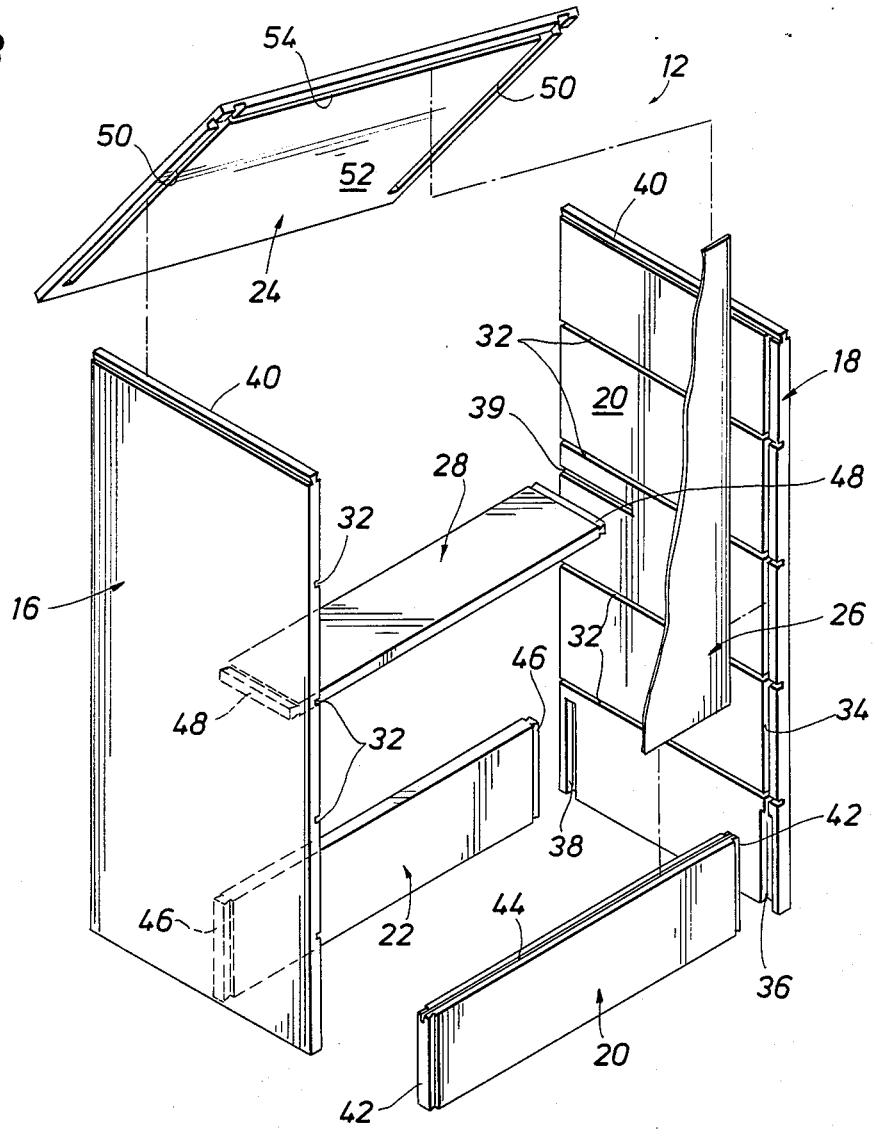
FIG. 3 is an exploded view of the frame for the chest of drawers showing the seven pieces forming the frame.

Referring now to the drawings for a better understanding of this invention and more particularly to FIGS. 1 and 2 an assembled chest of drawers formed in accordance with the invention is shown generally at 10. Chest of drawers 10 includes a frame or case indicated generally at 12 and a plurality of drawers therein each being indicated generally at 14 and supported by frame 12 for sliding movement.

Referring to FIG. 3, the assembly of frame 12 from seven flat panels and the machining or forming of the panels for assembly is explained. Frame 12 includes a pair of vertical side panels 16 and 18, a pair of lower vertical back and front base panels or rails 20 and 22 respectively, a top horizontal cover panel 24, a vertical back panel 26, and an intermediate horizontal reinforcing or stabilizing panel 28.

The terms employed in the specification and claims herein such as "vertical", "horizontal", "front", "rear", "upper" and "lower" are in reference to the completed chest of drawers 10 as shown in FIGS. 1 and 2 and are employed for ease of identification, and not as a limitation prior to completion of the assembled chest of drawers 10.

Side panels 16, 18 are identical and each panel 16, 18 has an inner side 30 formed with a plurality of horizontally extending dovetail grooves 32 across the width thereof. A vertical dovetail groove 34 extends along the length of the back of each panel 16,18. The lower end portion of groove 34 is enlarged at 36. An enlarged vertical dovetail groove 38 is provided along the front of each panel 16,18 below the lowermost horizontal groove 32. A horizontal dovetail groove 39 is formed intermediate the height of side panels 16, 18 and extends from the front edges of panels 16, 18 for a portion of the width thereof. A dovetail tongue 40 extends from the upper edge of each panel 16,18.

Rear base rail or panel 20 has dovetail tongues 42 on its ends which are adapted to fit within enlarged diameter grooves 36 on side panels 16, 18. A groove 44 is provided along the upper edge of base panel 20. Front base rail or panel 22 has dovetail tongues 46 which are adapted to fit within mating dovetail grooves 38 on side panels 16, 18.

Back panel 26 is adapted for fitting within grooves 34 and 44. Intermediate or center panel 28 has dovetail tongues 48 on its ends which are adapted to fit within dovetail grooves 39 in interlocking relation for stabilizing side panels 16, 18.

Upper horizontal top cover panel 24 has a pair of parallel dovetail grooves 50 in its inner side 52 and a connecting groove 54 extends between grooves 50. Dovetail tongues 40 are adopted to fit in interlocking relation with dovetail grooves 50 and the upper end of backing panel 26 is received within groove 54.

For assembly of frame 12, dovetail grooves 36 and 38 of side panels 16 and 18 are interlocked with dovetail tongues 42 and 46 of panels 20 and 22. Then, center panel 28 with dovetail tongues 48 is interlocked in dovetail grooves 39 of side panels 16, 18. Next, back panel 26 is inserted within grooves 34 of side panels 16, 18 and within groove 44 of rear base panel 20. Upper cover panel 24 is then positioned with dovetail grooves 50 interlocking with dovetail tongues 40 on side panels 16, 18 and groove 54 receiving the extending end of back panel 26. Lower base panel 20 may be loosened if necessary in order for backing panel 26 to be received adequately within groove 54. Assembled frame 12 is now in position to receive drawers 14.

Figure 4:
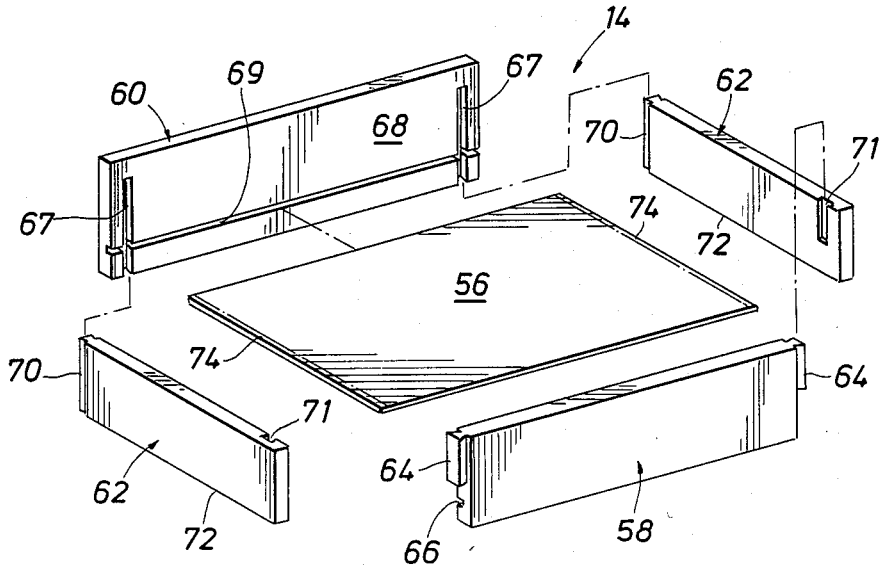
FIG. 4 is an exploded view of a drawer for the chest of drawers showing the five pieces forming the drawer.

Referring to FIG. 4, a drawer 14 is shown in disassembled relation and includes five separate interfitting parts or pieces consisting of a bottom horizontal panel 56, a rear vertical panel 58, a front vertical panel 60, and a pair of connecting side panels 62. Rear panel 58 has a dovetail tongue 64 formed along each end edge and a horizontal groove 66 along its inner side for securing bottom panel 56 therein. It is noted that panel 58 has a length less than the length of bottom panel 56. Front vertical panel 60 has a pair of vertically extending parallel dovetail grooves 67 along its inner side 68. A horizontal groove 69 connects grooves 67 and is adapted to receive an end of bottom panel 56 therein. Vertical side panels 62 have a dovetail tongue 70 at one end thereof adapted to fit within grooves 67 of panel 60, and a dovetail groove 71 adjacent the other end thereof adapted to receive dovetail tongues 64 of back panel 58.

For assembly of drawer 14, dovetail tongues 70 on sides 62 are interlocked within grooves 67 above horizontal groove 69. Then, bottom panel 56 is inserted within groove 69 beneath side panels 62 with the lower edges 72 of side panels 62 supported on and in contact with the upper face of bottom panel 56. Then, dovetail tongues 64 on rear panel 58 are inserted within interlocking grooves 71 with groove 66 receiving the adjacent end of bottom panel 56. Panel 56 is somewhat flexible and snaps within groove 66 after engaging the bottom edge of rear panel 58. Side marginal portions 74 of bottom panel 56 extend laterally outwardly of side panels 62 to form support flanges which are received within a pair of opposed grooves 32 of frame sides 16 and 18 for supporting drawer 14 for sliding movement in frame 12.

The tongues and grooves for the various panels may be easily machined or formed in the panels by suitable tools. While the various panels are preferably formed of wood, such as plywood, laminated wood, pressed wood, for example, the panels could be formed of other materials such as plastic or combined wood and plastic materials.

Backing panel 26 for frame 12 and bottom 56 for drawer 14 and relatively thin panels, such as 3/16 inch thickness, and are not formed with any tongues and grooves. A material such as a Masonite material or pressed wood construction may be utilized for panels 26 and 56.

As shown in FIGS. 1 and 2, four drawers 14 are mounted for sliding movement within frame 12 with each drawer 14 supported by flanges 74 fitting within a pair of opposed grooves 32. Front panel 60 for each drawer 14 is of a length sufficient to fit against the front edges of side panels 16 and 18 in the closed position of the drawer.

From the above, it is apparent that a knock down chest of drawers has been provided in which the frame and drawers may be easily assembled by an unskilled person in a minimum of time from a prepackaged set of flat panels without the use of any fasteners.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method for manually assemblying a plurality of drawers from a plurality of flat panels with the assembled drawers adapted to be received in sliding supporting relation within a plurality of vertically spaced pairs of opposed horizontal grooves in spaced parallel vertical sides of a frame for a chest of drawers;

said method comprising the following assembly steps for each of said drawers:

providing a flat bottom panel;

providing vertically extending front and back panels with a horizontal groove to form a pair of opposed horizontal grooves;

mounting said flat bottom panel within said opposed horizontal grooves of said vertically extending front and rear panels with side marginal portions of said bottom panel extending laterally outwardly beyond the ends of said rear panel to form projecting side supporting flanges; and connecting a pair of vertical side panels to said front and back panels at mating interlocking joints adjacent the ends of said front and back panels with the lower edges of said side panels supported on the upper surface of said bottom panel inwardly of said projecting side supporting flanges whereby said drawer may be positioned within a frame for a chest of drawers and wholly supported in sliding relation on said projecting flanges received within a pair of said opposed horizontal grooves of said frame

2. The method as set forth in claim 1 including the steps of forming the mating interlocking joints for connecting the vertical side panels to said front and back panels solely from interlocking dovetail tongue and groove connections.

3. The method as set forth in claim 2 including the step of forming said front panel with pair of parallel vertially extending dovetail grooves above the horizontal groove therein for receiving dovetail tongues on said side panels in interlocking relation.

4. A method of manually assemblying a frame and a plurality of associated drawers to form a chest of drawers from a plurality of packaged individual flat panels containing mating interlocking joints; said method including preassemblying each drawer in the following steps:

providing a flat bottom panel;

providing vertically extending front and rear panels with horizontal grooves therein for securing said flat bottom panel with side marginal portions of said bottom panel extending laterally outwardly beyond the ends of said back panel to provide projecting side supporting flanges;

connecting a pair of side panels to said front and back panels solely at mating interlocking joints adjacent the ends of said front and back panels with the lower edges of said side panels supported on the upper surface of said bottom panel inwardly of said projecting side supporting flanges thereby to form said plurality of drawers for placing within the frame;

said method further including assembly of the frame for receiving each drawer in the following steps:

providing a pair of spaced sides each having a plurality of vertically spaced parallel horizontally extending grooves extending between the front and back edges of said sides and adapted to receive in supporting relation said projecting side supporting flanges of said drawers for wholly supporting said drawers in sliding relation;

mounting a pair of lower base panels being said sides along the front and rear ends thereof and connecting said base panels to said sides at mating interlocking joints;

mounting a top horizontal over said sides and connecting said top panel to said sides at mating interlocking joints; and mounting a vertical back panel within vertically extending grooves in said sides thereby to form the assembled frame;

then inserting said preassembled drawers within said assembled frame with said projecting side flanges on said drawers being received in sliding supporting relation within said horizontally extending grooves in said frame sides for wholly supporting said drawers therein and completing the assembly of the chest of drawers.

5. The method as set forth in claim 4 including the step of forming all of said mating interlocking joints solely from interlocking dovetail tongue and groove connections.

6. The method of manufacture of a frame and a plurality of associated drawers for forming a chest of drawers from a plurality of individual flat panels; said method of manufacture comprising the following steps:

machining a plurality of parallel transverse grooves across the width of a pair of sides for the frame of said chest of drawers;

machining a longitudinal groove along the length of said sides adjacent a back edge thereof of adapted to receive a back panel therein;

enlarging said longitudinal groove adjacent the bottom thereof to form an enlarged diameter bottom end portion;

machining an enlarged diameter longitudinal groove adjacent the front edge of said side for a portion of the length of said sides adjacent the bottom thereof;

machining a dovetail tongue along the upper edge of each of said sides;

machining a tongue along opposed ends of a pair of vertical base panels to define front and rear base panels for fitting within the enlarged diameter longitudinal grooves adjacent the respective front and rear edges of said sides;

machining a pair of dovetail side grooves along the sides of a top horizontal cover panel adapted to interfit with the dovetail tongues along the upper edges of said sides;

machining a groove along the back of said top cover panel extending between said pair of side grooves and adapted to receive a back panel therein;

machining a groove along the upper horizontal edge of said vertical base panel in opposed relation to said grooves along the back of said top panel and adapted to receive said back panel therein for said frame;

machining front and rear vertical panels for each drawer with a longitudinal groove along the bottom edge thereof to receive a bottom panel therebetween for each of a plurality of drawers with said rear vertical panel being of a length less than the length of the bottom panel for defining opposed supporting side flanges on said bottom panel extending beyond the ends of said rear panel;

and connecting a pair of vertical side panels for each drawer to said front and back panels adjacent the ends thereof with the lower edges of said side panels supported on the upper surface of said bottom panel inwardly of said supporting side flanges thereby to form a plurality of drawers with supporting flanges thereof adapted to be received for sliding movement within a horizontally aligned pair of transverse grooves in said sides of the frame for wholly supporting the drawers therein.

7. An improved chest of drawers including a frame and a plurality of drawers assembled from a plurality of flat panels and mounted within the frame for sliding movement between open and closed positions; said frame comprising:

a pair of opposed side panels having a plurality of opposed horizontal extending grooves therein arranged in vertically spaced relation to each other with each pair of opposed grooves adapted to receive a drawer therein in supporting relation;

a top panel fitting over said side panels and including interfitting joints between said side panels and said top panel for removably connecting the top panel to said side panels;

a pair of lower base panels extending between the lower ends of said side panels and including interfitting joints between said side panels and lower base panels; and a backing panel extending between said side panels adjacent the rear of said chest of drawer;

each of said drawers comprising:

a bottom panel having a pair of opposed supporting side flanges;

front and rear panels detachably connected to said bottom panel for supporting said bottom panel; and a pair of side panels extending between and detachably connected to said front and rear panels over said bottom panel, said side panels having lower edges supported on said bottom panel inwardly of the adjacent sides of said bottom panel with a portion of said bottom panel projecting outwardly in a horizontal direction from each adjacent side panel to define said opposed supporting side flanges, said drawer fitting within said frame with said opposed supporting side flanges of said bottom panel being received within a pair of opposed grooves in said frame side panels for wholly supporting the drawer therein for sliding movement between open and closed positions.

8. A knock down drawer adapted to be received within a frame of a chest of drawers and to be supported for sliding movement within a pair of opposed horizontal grooves in the sides of the frame; said drawer comprising:

a bottom panel having a pair of opposed supporting side flanges;

front and rear panels detachably connected to said bottom panel for supporting said bottom panel;

a pair of side panels extending between said front sand rear panels over said bottom panel and positioned in parallel relation to and inwardly of said side flanges; and interlocking dovetail tongue and groove joints connecting said side panels to said front and rear panels;

said side panels having lower edges supported on said bottom panel inwardly of the side flanges of said bottom panel and projecting outwardly in a horizontal direction from each adjacent side panel to define said opposed supporting side flanges, said supporting side flanges of said bottom panel adapted to be received within a pair of opposed horizontal grooves in a frame for a chest of drawers and to support the drawer for sliding movement therein.

9. A knock down drawer as set forth in claim 8 wherein said front panel has a pair of parallel vertical dovetail grooves therein adjacent each end thereof extending to the bottom edge thereof, and a horizontal groove adjacent the bottom edge extending between said vertical dovetail grooves;

said side panels having an interfitting dovetail tongue on an end thereof for interlocking with said dovetail grooves on said front panel at a position above said horizontal groove, said bottom panel fitting within said horizontal groove of said front panel beneath said side panels.

10. A knock down drawer as set forth in claim 9 wherein said rear panel has a dovetail tongue on each end thereof, and said side panels have interfitting dovetail grooves receiving said dovetail tongues.

* * * * *